US012662225B1

(12) United States Patent
Belter et al.

(10) Patent No.: US 12,662,225 B1
(45) Date of Patent: Jun. 23, 2026

(54) MARINE DRIVES AND METHODS FOR CLEARING DEBRIS FROM A COOLING WATER INTAKE ON A MARINE DRIVE

(71) Applicant: Brunswick Corporation, Mettawa, IL (US)

(72) Inventors: David J. Belter, Oshkosh, WI (US); Nicholas E. Nida, Fond du Lac, WI (US); Brett Bielefeld, Fond du Lac, WI (US); Robert Dreyer, Appleton, WI (US)

(73) Assignee: Brunswick Corporation, Mettawa, IL (US)

( * ) Notice: Subject to any disclaimer, the term of this patent is extended or adjusted under 35 U.S.C. 154(b) by 411 days.

(21) Appl. No.: 18/200,884

(22) Filed: May 23, 2023

(51) Int. Cl.
*B63H 20/30* (2006.01)
*B63H 20/20* (2006.01)

(52) U.S. Cl.
CPC ..... *B63H 20/30* (2013.01); *B63H 20/20* (2013.01)

(58) Field of Classification Search
CPC ..... B63H 20/20; B63H 20/30
See application file for complete search history.

(56) References Cited

U.S. PATENT DOCUMENTS

| | | | |
|---|---|---|---|
| 1,329,559 | A | 2/1920 | Tesla |
| 2,082,059 | A | 6/1937 | Irgens |
| 2,375,613 | A | 5/1945 | Clements |
| 2,670,757 | A | 3/1954 | Delany |
| 2,864,394 | A | 12/1958 | Hempel |
| 2,867,213 | A | 1/1959 | Thomas |
| 3,292,658 | A | 12/1966 | Domer |
| 3,374,630 | A | 3/1968 | Davison |
| 3,871,324 | A | 3/1975 | Snyder |
| 4,178,873 | A | 12/1979 | Bankstahl |
| 4,492,361 | A | 1/1985 | Jacquet et al. |
| 4,767,366 | A | 8/1988 | Lang |
| 4,925,412 | A | 5/1990 | Karls |
| 5,165,891 | A | 11/1992 | Young et al. |
| 5,577,941 | A | 11/1996 | Chartier |
| 5,846,105 | A | 12/1998 | Baker et al. |
| 5,876,258 | A | 3/1999 | Gray |
| 6,004,175 | A | 12/1999 | McCoy |
| 6,033,272 | A | 3/2000 | Whiteside |

(Continued)

FOREIGN PATENT DOCUMENTS

DE 69834979 T2 * 10/2006 ..... B01D 24/14

OTHER PUBLICATIONS

English translation of DE 69834979, Oct. 2006. (Year: 2006).*

(Continued)

*Primary Examiner* — Stephen P Avila
(74) *Attorney, Agent, or Firm* — Andrus Intellectual Property Law, LLP

(57) ABSTRACT

A marine drive includes a drive assembly which is operable in a neutral mode, in a forward mode for generating a forward thrust force in a body of water, and in a reverse mode for generating a reverse thrust force in the body of water. A water intake is configured to receive cooling water from the body of water for cooling at least one component of the drive assembly, and an electric pump configured to draw the cooling water into the drive assembly via the water intake. A control system is configured to modify a speed and/or a direction of the electric pump to facilitate a clearance of debris from the water intake.

24 Claims, 7 Drawing Sheets

(56) References Cited

U.S. PATENT DOCUMENTS

| | | | | |
|---|---|---|---|---|
| 6,089,272 | A | 7/2000 | Brand et al. | |
| 6,098,661 | A | 8/2000 | Mm et al. | |
| 6,273,771 | B1 | 8/2001 | Buckley et al. | |
| 6,325,683 | B1 | 12/2001 | Yocom | |
| 6,439,939 | B1 | 8/2002 | Jaeger | |
| 6,511,355 | B1 | 1/2003 | Woodward | |
| 6,532,909 | B2 | 3/2003 | Stauder et al. | |
| 6,899,575 | B1 | 5/2005 | Rothe et al. | |
| 7,377,826 | B1 | 5/2008 | Wengren, Jr. | |
| 8,651,908 | B1 | 2/2014 | Glodowski | |
| 8,714,200 | B2 | 5/2014 | Bushman et al. | |
| 9,334,034 | B1 | 5/2016 | Waldvogel et al. | |
| 10,011,341 | B1 | 7/2018 | Tuchscherer et al. | |
| 10,232,923 | B1 | 3/2019 | Novak et al. | |
| 10,800,502 | B1 | 10/2020 | Alby et al. | |
| 10,940,929 | B2 | 3/2021 | Eatwell | |
| 11,352,937 | B1 | 6/2022 | Dreyer et al. | |
| 11,459,078 | B1 | 10/2022 | Fregonese et al. | |
| 2006/0009097 | A1* | 1/2006 | Roos | B63H 21/305 440/111 |
| 2009/0056951 | A1 | 3/2009 | Mosher et al. | |
| 2016/0245189 | A1 | 8/2016 | Raimbault et al. | |
| 2020/0318584 | A1* | 10/2020 | Clark | F02M 35/024 |
| 2020/0370463 | A1* | 11/2020 | Saruwatari | F01P 3/202 |

OTHER PUBLICATIONS

Office Action issued in U.S. Appl. No. 18/462,568, dated Feb. 13, 2026.

Notice of Allowance issued in U.S. Appl. No. 18/462,576, dated May 5, 2026.

* cited by examiner

MARINE DRIVES AND METHODS FOR CLEARING DEBRIS FROM A COOLING WATER INTAKE ON A MARINE DRIVE

FIELD

The present disclosure relates to marine drives, and in particular marine drives having a pump for pumping cooling water through the marine drive.

BACKGROUND

The following U.S. Patents are incorporated herein by reference in entirety.

U.S. Pat. No. 6,899,575 discloses a water pump in addition to the impeller system of a marine propulsion system. This allows the water pump to operate independently of the impeller if a clutch is provided which disconnects the impeller from torque transmitting relation with an engine. When a clutch is not provided, the independent water pump allows the marine propulsion system to be operated at a lower idle speed than would otherwise be possible because the impeller is not relied upon for a flow of cooling water to the engine.

U.S. Pat. No. 11,352,937 discloses a marine drive for propelling a vessel in body of water. The marine drive has a powerhead, a crankcase on the powerhead, and a cooling system that pumps a first flow of cooling water from the body of water through a powerhead cooling conduit for cooling the powerhead and in parallel pumps a second flow of cooling water from the body of water through a crankcase cooler for cooling the crankcase and lubricant in the crankcase. A valve controls the second flow of the cooling water to the crankcase cooler. The valve is normally positioned in a closed position, which inhibits the second flow of cooling water to the crankcase cooler and thereby reduces condensation of water from the lubricant in the crankcase. The valve is moved into an open position upon operation of the powerhead at or above a threshold speed, which permits the second flow of cooling water to the crankcase cooler and thereby cools the lubricant in the crankcase.

SUMMARY

This Summary is provided to introduce a selection of concepts which are further described herein below in the Detailed Description. This Summary is not intended to identify key or essential features of the claimed subject matter, nor is it intended to be used as an aid in limiting the scope of the claimed subject matter.

In non-limiting examples disclosed herein, a marine drive includes a drive assembly which is operable in a neutral mode, in a forward mode for generating a forward thrust force in a body of water, and in a reverse mode for generating a reverse thrust force in the body of water, a water intake configured to receive cooling water from the body of water for cooling at least one component of the drive assembly, an electric pump configured to draw the cooling water into the drive assembly via the water intake, and a control system configured to modify a speed and/or a direction of the electric pump to facilitate a clearance of debris from the water intake.

Optionally, the control system is configured to modify said speed of the electric pump based upon whether the drive assembly undergoes a shift change or a request for said shift change from the neutral mode to at least one of the forward mode and the reverse mode. Optionally, the control system is configured to determine whether the drive assembly undergoes said shift change by comparing a current throttle amount or a requested throttle amount to a stored throttle amount. Optionally, the control system is configured to modify said speed of the electric pump by slowing or stopping the electric pump. Optionally, the control system is configured to revert to said speed of the electric pump after expiration of a predetermined time period stored in a memory of the control system. Optionally, the control system is configured to revert to said speed of the electric pump after a temperature of the at least one component of the marine drive reaches a threshold temperature stored in a memory of the control system. Optionally, the control system is configured to revert to said speed of the electric pump when the drive assembly undergoes a shift change or a request for shift change from the at least one of the forward mode and the reverse mode back to the neutral mode. Optionally, the electric pump is a bidirectional electric pump and wherein the control system is configured to facilitate the clearance of debris from the water intake by causing the electric pump to pump cooling water out of the water intake instead of into the water intake. Optionally, the control system is configured to facilitate the clearance of debris from the water intake by causing the electric pump to pulse cooling water flow into the water intake by decreasing and then increasing said speed the electric pump. Optionally, the control system is configured to cycle the electric pump on and off to facilitate the clearance of debris from the water intake. Optionally, control system is configured to modify said speed of the electric pump based upon how a pressure of the cooling water in the cooling system compares to a stored threshold pressure. The stored threshold pressure may for example be based on current speed of the electric pump and/or current speed of the marine vessel.

In non-limiting examples disclosed herein, a method of operating a cooling system on a marine drive includes operating a drive assembly in one of a neutral mode, in a forward mode for generating a forward thrust force in a body of water, and in a reverse mode for generating a reverse thrust force in the body of water, operating an electric pump to draw cooling water from the body of water through a water intake for cooling at least one component of the marine drive, and modifying a speed and/or a direction of the electric pump to facilitate a clearance of debris from the water intake.

Optionally, the method includes modifying said speed of the electric pump based upon whether the drive assembly undergoes a shift change or a request for said shift change from the neutral mode to at least one of the forward mode and the reverse mode. Optionally, the method includes determining whether the drive assembly undergoes said shift change by comparing a current throttle amount to a stored throttle amount. Optionally, the method includes modifying said speed of the electric pump by slowing or stopping the electric pump. Optionally, the method includes reverting to said speed of the electric pump after expiration of a stored time period. Optionally, the method includes reverting to said speed of the electric pump after a temperature of the at least one component of the drive assembly reaches a stored threshold temperature. Optionally, the method includes reverting to said speed of the electric pump when the drive assembly undergoes said shift change. Optionally, the electric pump is a bidirectional electric pump and the method includes controlling the electric pump to facilitate the clearance of debris from the water intake by causing the electric pump to temporarily pump cooling water out of the water intake. Optionally, the method includes controlling the electric pump to facilitate the clearance of debris from the water intake by causing the electric pump to pulse cooling water flow into the water intake by decreasing and then increasing said speed of the electric pump. Optionally, the method includes cycling the electric pump on and off to facilitate the clearance of debris from the water intake. Optionally, the method includes modifying said speed of the electric pump based on a comparison of pressure of the cooling water in the cooling system to a stored threshold pressure. The stored threshold pressure may be based on current speed of the electric pump and/or current speed of the marine vessel.

BRIEF DESCRIPTION OF THE DRAWINGS

The present disclosure includes the following figures.

DETAILED DESCRIPTION

Figure 1:
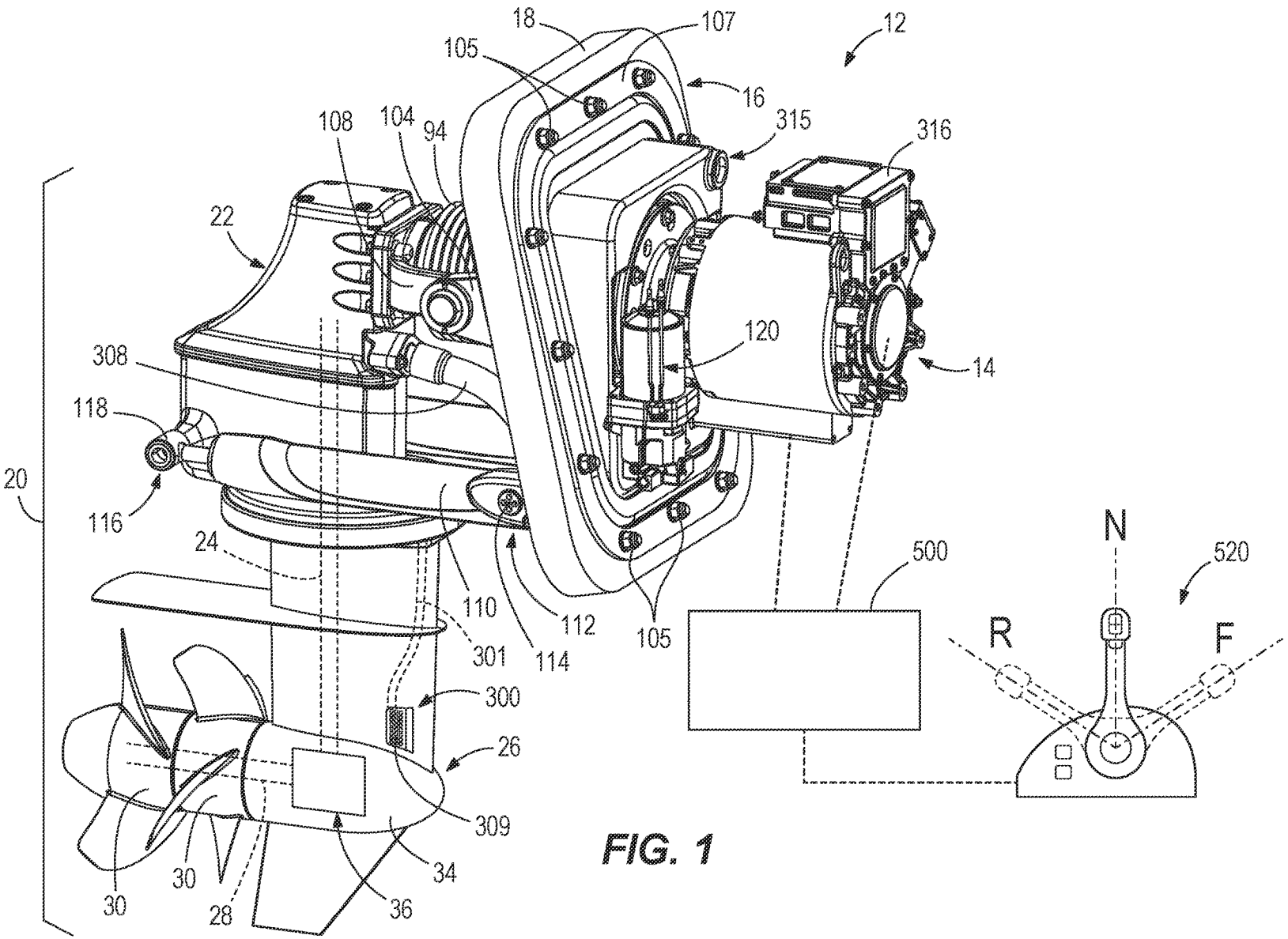
FIG. 1 is a starboard side perspective view of a marine drive according to the present disclosure.

FIGS. 1-4 illustrate a marine drive, such as a stern drive 12, for propelling a marine vessel in a body of water. The example shown in the figures is not limiting, however, and the present invention is applicable to a wide variety of marine drives, including but not limited to outboard motors. Referring to FIG. 1, the stern drive 12 has a powerhead, which in the illustrated example is an electric motor 14, a mounting assembly 16 which affixes the electric motor 14 to and suspends the electric motor 14 from the transom 18 of the marine vessel, and a drive assembly 20 coupled to the mounting assembly 16. The illustrated powerhead is not limiting however and in other examples the powerhead may include an engine and/or a combination of an engine and an electric motor, and/or any other suitable means for powering a marine drive. The mounting assembly 16 is configured so that the powerhead which in the illustrated example is an electric motor 14 is suspended (i.e., cantilevered) from the interior of the transom 18, above the bottom of the hull of the marine vessel. The drive assembly 20 is trimmable up and down relative to the mounting assembly 16, including in non-limiting examples wherein a majority or an entirety of the drive assembly 20 is raised completely out of the water.

The drive assembly 20 has a driveshaft housing 22 containing a driveshaft 24 (see FIG. 1) and a gearcase housing 26 containing one or more output shaft(s) 28 (see FIG. 1), e.g., one or more propulsor shaft(s). The output shaft(s) 28 extends from the rear of the gearcase housing 26 and support one or more propulsors(s) 30 configured to generate thrust in the water for propelling the marine vessel. The output shaft(s) 28 extend generally transversely to the driveshaft 24. In the illustrated example, propulsor(s) 30 include two counter-rotating propellers. However this is not limiting and the present disclosure is applicable to other arrangements, including arrangements wherein one or more output shaft(s) 28 are not counter rotating and/or wherein the one or more output shaft(s) 28 extend from the front of the gearcase housing 26, and/or wherein the propulsor(s) 30 include one or more impellers and/or any other mechanism for generating a propulsive force in the water.

The drive assembly 20 (FIG. 1) is operable in one or more propulsion modes. The type and number of propulsion modes can vary, and in one non-limiting examples, the drive assembly 20 is operable in a neutral mode in which the drive assembly 20 is not generating thrust or generates very little thrust, a forward mode in which the drive assembly 20 is generating a forward thrust force in the body of water, and in a reverse mode for generating a reverse thrust force in the body of water.

The gearcase housing 26 is steerable about a steering axis S (see FIG. 4) relative to the driveshaft housing 22. The gearcase housing 26 (see FIG. 1) has a steering kingpin 32 (see FIG. 4) which extends upwardly into the driveshaft housing 22, as well as a torpedo housing 34 which extends from the gearcase housing 26. A bevel gearset 36 (see FIG. 1) in the torpedo housing 34 operably couples the lower end of the driveshaft 24 to the output shaft(s) 28 so that rotation of the driveshaft 24 causes rotation of the output shaft(s) 28, which in turn causes rotation of the propulsor(s) 30.

Figure 4:
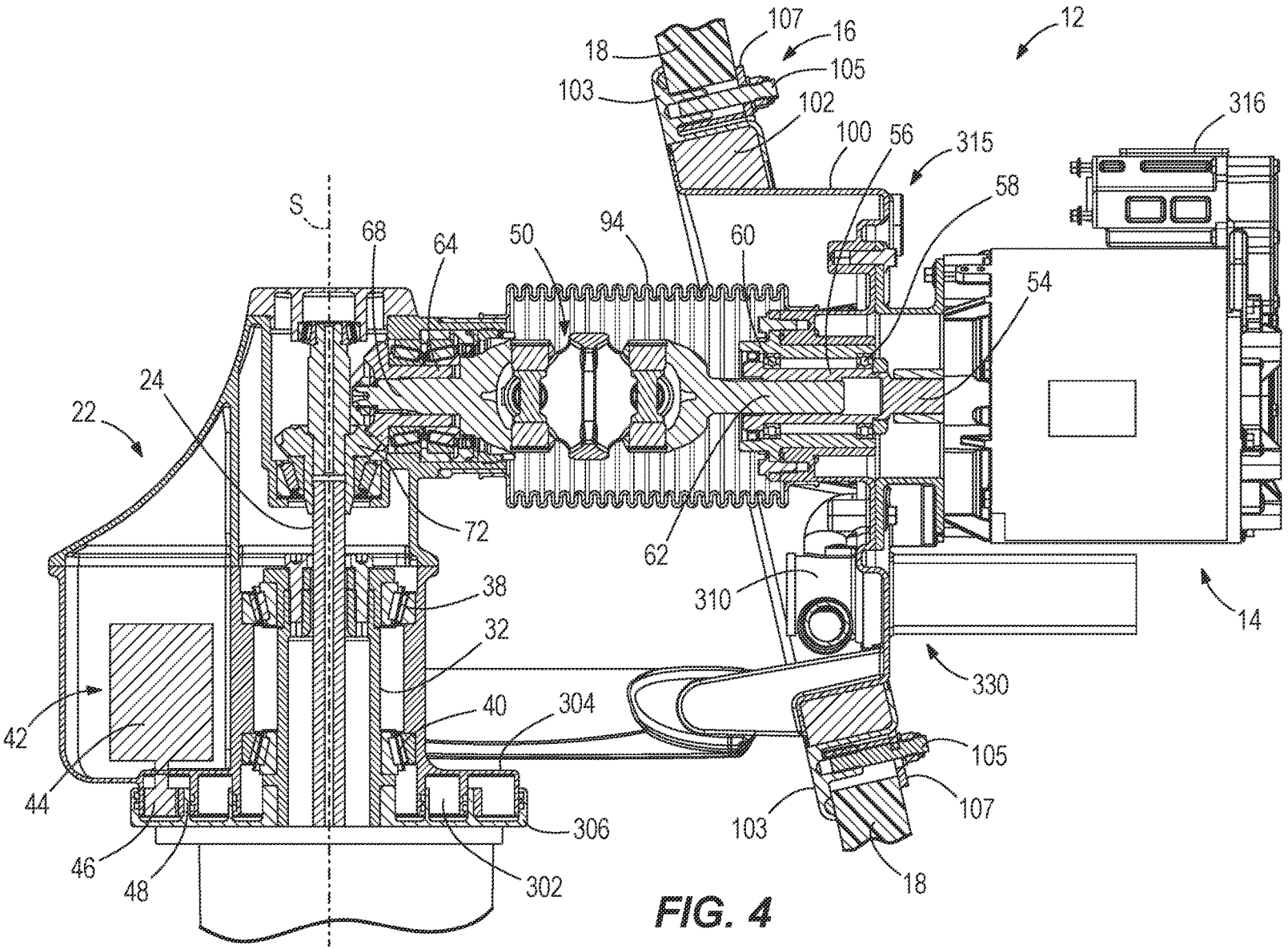
FIG. 4 is a starboard side cross-sectional view of the marine drive.

Referring to FIG. 4, upper and lower bearings 38, 40 are disposed radially between the steering kingpin 32 and the driveshaft housing 22. The upper and lower bearings 38, 40 rotatably support the steering kingpin 32 relative to the driveshaft housing 22. A steering actuator 42 is configured to cause rotation of the gearcase housing 26 relative to the driveshaft housing 22. In the illustrated example, the steering actuator 42 is an electric motor 44 located in the driveshaft housing 22. The electric motor 44 has an output gear 46 which is meshed with a ring gear 48 on the steering kingpin 32 so that rotation of the output gear 46 causes rotation of the gearcase housing 26 about the steering axis S. Operation of the electric motor 44 can be controlled via a user input device located at the helm of the marine vessel or elsewhere, which facilitates control of the steering angle of the gearcase housing 26 and associated propulsors(s) 30. This facilitates steering control of the marine vessel. The type and configuration of the steering actuator 42 can vary from what is shown, and in other examples, the steering actuator 42 can include one or more hydraulic actuators, electro-hydraulic actuators, and/or any other suitable actuator for causing rotation of the gearcase housing 26. Other suitable examples are disclosed in U.S. Pat. No. 10,800,502, which is hereby incorporated by reference in its entirety.

A universal joint 50 (FIG. 4) couples the electric motor 14 to the driveshaft 24 so that operation of the electric motor 14 causes rotation of the driveshaft 24, which in turn causes rotation of the output shaft(s) 28 (FIG. 1). The universal joint 50 is also advantageously configured to facilitate trimming of the drive assembly 20 an amount sufficient to raise at least a majority of the drive assembly 20 out of the water, for example during periods of non-use.

An internally splined sleeve 56 is rotatably supported in the mounting assembly 16 by inner and outer bearings 58, 60. The output shaft 54 of the electric motor 14 is fixed to the splined sleeve 56 so that rotation of the output shaft 54 causes rotation of the splined sleeve 56. The externally-splined input shaft 62 of the universal joint 50 extends into meshed engagement with the splined sleeve 56 so that rotation of the splined sleeve 56 causes rotation of the input member 52. The output shaft 68 of the universal joint 50 is coupled to the driveshaft 24 by an bevel gearset 72 located in the driveshaft housing 22 and configured so that rotation of the output member 64 causes rotation of the driveshaft 24.

Thus, it will be understood that operation of the electric motor 14 causes rotation of the universal joint 50, which in turn causes rotation of the driveshaft 24 and output shaft(s) 28. The splined engagement between the input member 52 and splined sleeve 56 also advantageously permits telescoping movement of the input member 52 during trimming of the drive assembly 20. A flexible bellows 94 encloses the universal joint 50 relative to the mounting assembly 16 and the driveshaft housing 22.

The mounting assembly 16 is configured to couple the drive assembly 20 to the transom 18 outside of the marine vessel and suspend the electric motor 14 from the transom 18 inside of the marine vessel. The mounting assembly 16 has a rigid mounting plate 100, a vibration dampening (e.g., rubber or other pliable and/or resilient material) mounting ring 102, and a rigid mounting ring 103 which is fastened to the transom 18 by fasteners 105 and a fastening ring 107 to couple the vibration dampening mounting ring 102 and rigid mounting plate 100 to the transom 18.

Figure 2:
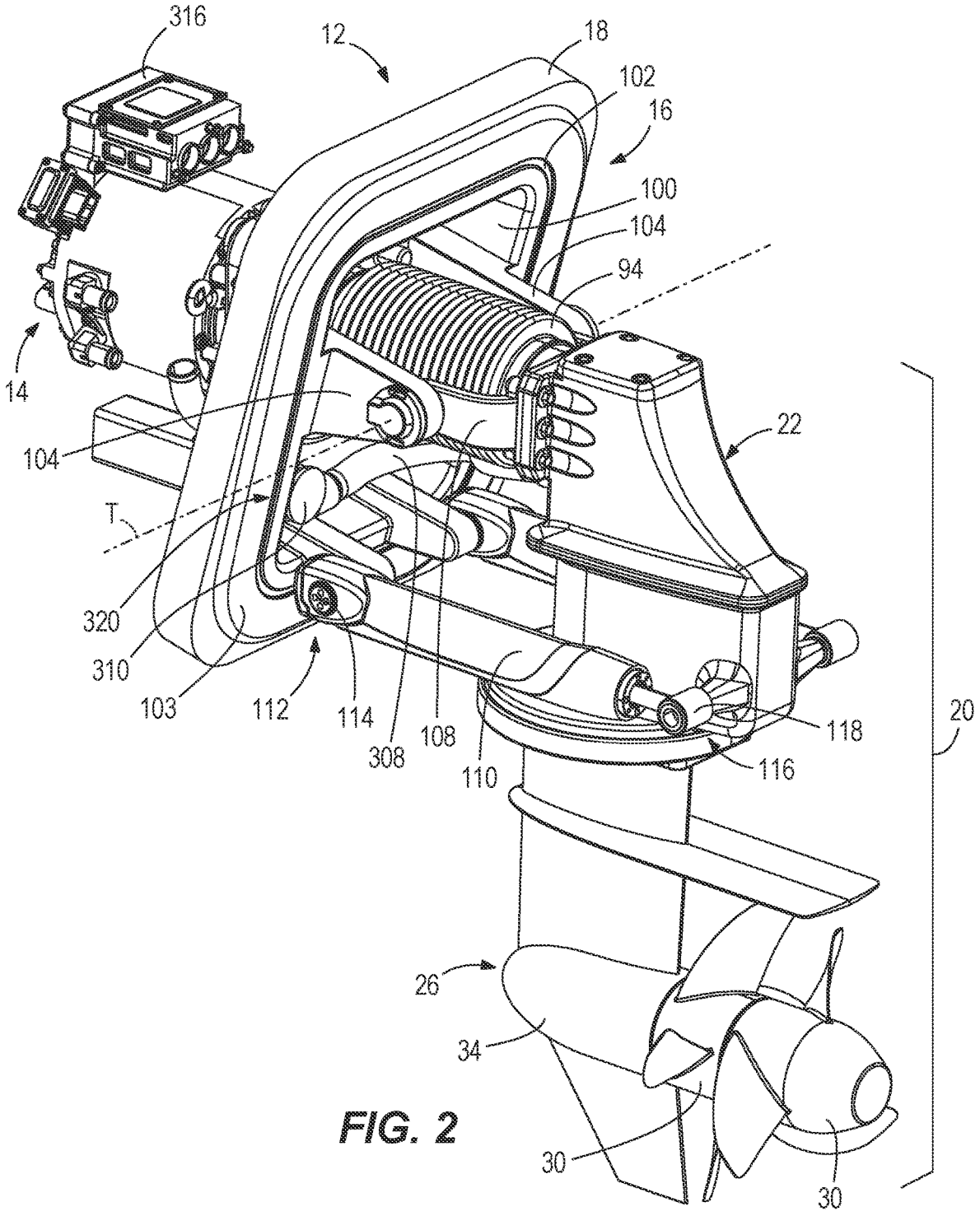
FIG. 2 is a port side perspective view of the marine drive.

Referring now to FIG. 2, a pair of rigid mounting arms 104 (FIG. 2) extends rearwardly from the rigid mounting plate 100 (FIG. 2) and is pivotably coupled to a rigid, U-shaped mounting bracket 108 (FIG. 2) extending forwardly from the top of the driveshaft housing 22. The pivot joint between the rigid mounting arms 104 and the mounting bracket 108 defines a trim axis T (see FIG. 2) about which the drive assembly 20 is pivotably (trimmable), up and down relative to the mounting assembly 16. The type and configuration of mounting assembly 16 can vary from what is shown.

Trim cylinders 110 (see also FIG. 1) are located on opposite sides of the mounting assembly 16. The trim cylinders 110 have a first end 112 pivotably coupled to the rigid mounting plate 100 at a first pivot joint 114 and an opposite, second end 116 pivotably coupled to the drive assembly 20 at a second pivot joint 118. A hydraulic actuator 120 (see FIG. 1; which in this example includes a pump and associated valves and line components) is mounted to the interior of the rigid mounting plate 100. The hydraulic actuator 120 is hydraulically coupled to the trim cylinders 110 via a least one internal passage through the mounting assembly 16 and the first pivot joint 114, advantageously so that there are no other hydraulic lines located on the exterior of the stern drive 12, or otherwise outside the marine vessel so as to be subjected to wear and/or damage from external elements. The hydraulic actuator 120 is operable to supply hydraulic fluid to the trim cylinders 110 via the noted internal passage to cause extension of the trim cylinders 110 and alternately to cause retraction of the trim cylinders 110. Extension of the trim cylinders 110 pivots (trims) the drive assembly 20 upwardly relative to the mounting assembly 16 and retraction of the trim cylinders 110 pivots (trims) the drive assembly 20 downwardly relative to the mounting assembly 16. Examples of a suitable hydraulic actuator are disclosed in U.S. Pat. No. 9,334,034, which is hereby incorporated by reference in its entirety. The universal joint 50 advantageously facilitates trimming of the drive assembly 20 about the trim axis T (see FIG. 2) while maintaining operable connection between the electric motor 14 and the output shaft(s) 28.

Figure 5:
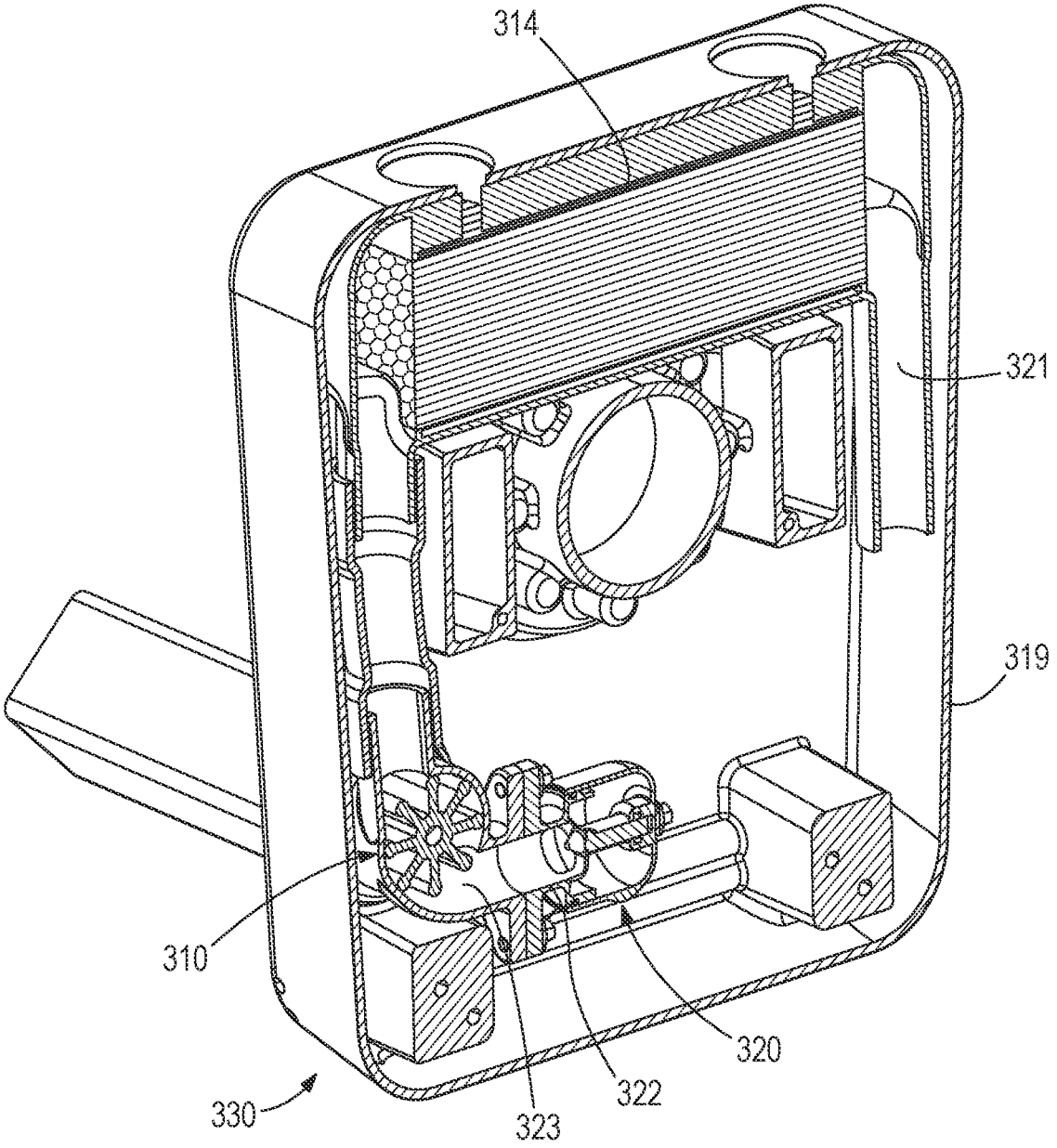
FIG. 5 is a cross-sectional view of an example cooling system of a marine drive according to the present disclosure.

Referring to FIGS. 1 and 5, the stern drive 12 has a cooling system 330 for cooling various components of the stern drive 12, including but not limited to the electric motor 14 and related components. In a non-limiting example, the cooling system 330 includes an open loop cooling circuit for circulating cooling water from the body of water in which the stern drive 12 is situated to various components of the stern drive 12 and then discharging the spent cooling water back to the body of water. The open loop cooling circuit comprises a water intake 300 (see FIG. 1) on the gearcase housing 26 which is connected via a conduit 301 to a cooling channel 302 (FIG. 4) defined between a lower annular flange 304 on the lower end of the driveshaft housing 22 and a second annular flange 306 on the top of the gearcase housing 26. Reference is made to the above-incorporated U.S. Pat. No. 10,800,502 which teaches this type of cooling conduit.

A flexible conduit 308 (FIG. 1) is coupled to the driveshaft housing 22 and configured to convey the cooling water from the cooling channel 302 (FIG. 4) to an electric pump 310 (FIG. 4) mounted on the transom mounting assembly 16. The electric pump 310 is configured to draw the cooling water in via the water intake 300, see FIG. 1, through the cooling channel 302, and through the flexible conduit 308. In certain examples, the electric pump 310 is powered by an electrical power source, such as a rechargeable battery, and further controlled by a control system 500 such that the operational speed of the electric pump 310 can be modified to vary the flow direction and/or the flow rate of the water being pumped by the electric pump 310 (described in greater detail herein below). In certain examples, the electric pump 310 is an electric pump however this is not limiting.

The electric pump 310 pumps the cooling water to a heat exchanger 314 (see FIG. 5) and then to an outlet, such as the outlet 315 shown in FIG. 1. Note that the stern drive 12 can further include a closed loop cooling circuit having a pump for pumping cooling fluid such as a mixture of water and ethylene glycol through the heat exchanger 314 thereby exchanging heat with the cooling water in the open loop cooling circuit. The mixture of water and ethylene glycol is circulated past the electric motor 14, an associated inverter 316 (FIG. 1), and/or one or more batteries for powering the electric motor 14, thus cooling these components. This cooling system is not limiting however and the stern drive 12 may include a wide variety of other components which are cooled by the system and the system may have a wide variety of other configurations.

Referring now to FIG. 5, a non-limiting example open loop cooling circuit for the cooling system 330 is partially depicted. The electric pump 310 is coupled to the mounting assembly 16 (see FIG. 1). The conduit 308 (FIG. 2) is coupled to a swivel joint 320 (FIG. 5) that is configured to rotate as the drive assembly 20 moves and/or trims thereby maintaining a fluid connection between the conduit 308 and a mounting boss 322. The electric pump 310 pumps the water through the swivel joint 320 and a conduit 323 (FIG. 5) to the heat exchanger 314 to thereby cool the cooling fluid in the closed cooling loop and the electric motor 14, the inverter 316 (FIG. 1), and/or one or more batteries, as noted above. The water passes out of the heat exchanger 314 and through an outlet conduit 321 to the environment in a manner known in the art.

The present inventors have recognized that during operation of the stern drive 12, the water intake 300 (FIG. 1), specifically the holes thereof, can become clogged (e.g., seaweed) due to the normal flow of water into the cooling system 330. The debris that is mixed with the incoming water can be strained by the water intake 300 as the water flows into the cooling system 330 and thereby clog the water intake 300. Furthermore, the debris may flow with the water into the other portions of the cooling system 330, such as the cooling channel 302 and/or the heat exchanger 314, such that clogs develop therein. These clogs can prevent efficient operation of the cooling system 330 by reducing the flow of cool water to heat exchanger 314 and/or heat-generating components of the stern drive 12. If not properly cooled, heat exchanger 314 and/or the other heat-generating components of the stern drive 12 may malfunction and/or require repair. In addition, the clogs can decrease the flow rate of the water and thus the electric pump 310 may operate for longer periods of time to thereby supply enough cooling water to the heat exchanger 314 and/or other heat-generating components of the stern drive 12. As such, the efficiency and/or life of the electric pump 310 is reduced.

The present inventors have noted if screens or screen inserts 309 are optionally provided at the water intake 300 to prevent debris from clogging components of the cooling system 330, maintenance may be required to clean the screens or screen inserts 309 (e.g., scrubbing the screens or screen inserts 309, removing the screen inserts 309 for cleaning or replacement). The screens or screen inserts 309 may strain debris at the water intake 300, and the vacuum created by the pump 310 may hold the debris to the water intake 300 and/or the screens or screen inserts 309 thereby creating a restriction to water flow (e.g., a pocket defined between the screen inserts 309 and the gearcase housing 26 may trap debris that should be cleared). To avoid these problems, the present inventors developed the methods of the present disclosure which facilitate clearing debris from the holes of the water intake 300 and/or the screens or screen inserts 309 thereby reducing maintenance requirements related to clearing debris and/or cleaning the water intake 300 and/or the screens or screen inserts 309. The present inventors have also recognized that the methods of the present disclosure can also be utilized in conjunction with water intakes 300 and/or screens or screen inserts 309 by automatically changing the speed and/or a direction of the pump 310 to clear debris therefrom.

The present inventors have further noted that the diameter of the inlet holes of the conventional water intakes are often greater than the diameter of the tubes in the heat exchanger through which the cooling water flows. As such, debris passing through the inlet holes of the water intake may become lodged at the header or in the tubes of the heat exchanger. Enlarging the diameter of the tubes in the heat exchanger may disadvantageously result in increasing the size of the heat exchanger required to provide adequate cooling and/or decreasing the efficiency of the heat exchanger. As such, the present inventors developed the methods of the present disclosure which facilitate clearing debris from the holes of the water intake 300 and prevent clogging of the tubes of the heat exchanger 314 such that the diameter of the holes of the water intake 300 can be reduced to prevent large debris from entering the cooling system 330 and/or utilize compact, efficient heat exchangers 314 that take up less space on the marine vessel. The present inventors also developed the methods of the present disclosure such that smaller holes in the water intake can be utilized to thereby prevent large debris from entering the cooling system via the water intake (i.e. reducing the size of the holes prevents debris larger than the holes from entering the cooling system). By reducing the size of the holes in the water intake and preventing ingress of large debris, heat exchangers with small diameter tubes can be utilized. The methods of the present disclosure advantageously clear debris from water intake with small holes and the heat exchangers with small diameter tubes requires less space on the marine vessel.

In addition, the present inventors have recognized that debris may also be held on or over the water intake 300 due to the fluid pressure forces (e.g., vacuum forces) of the water flowing into the cooling system 330 via the water intake 300. As such, the debris covers or blocks at least a portion of the water intake 300 thereby reducing the flow of water into the cooling system 330. Note that fluid pressure forces holding the debris over the water intake 300 may be greater than the flow of water flowing past the water intake 300 as the marine vessel is moving through the body of water. As such, the movement of the marine vessel through the water may not clear the debris from the water intake 300. The debris covering the water intake 300 can prevent the efficient operation of the cooling system 330 and/or the electric pump 310 as noted above with respect to the debris that may clog the water intake 300 and/or other components of the cooling system 330.

Figure 3:
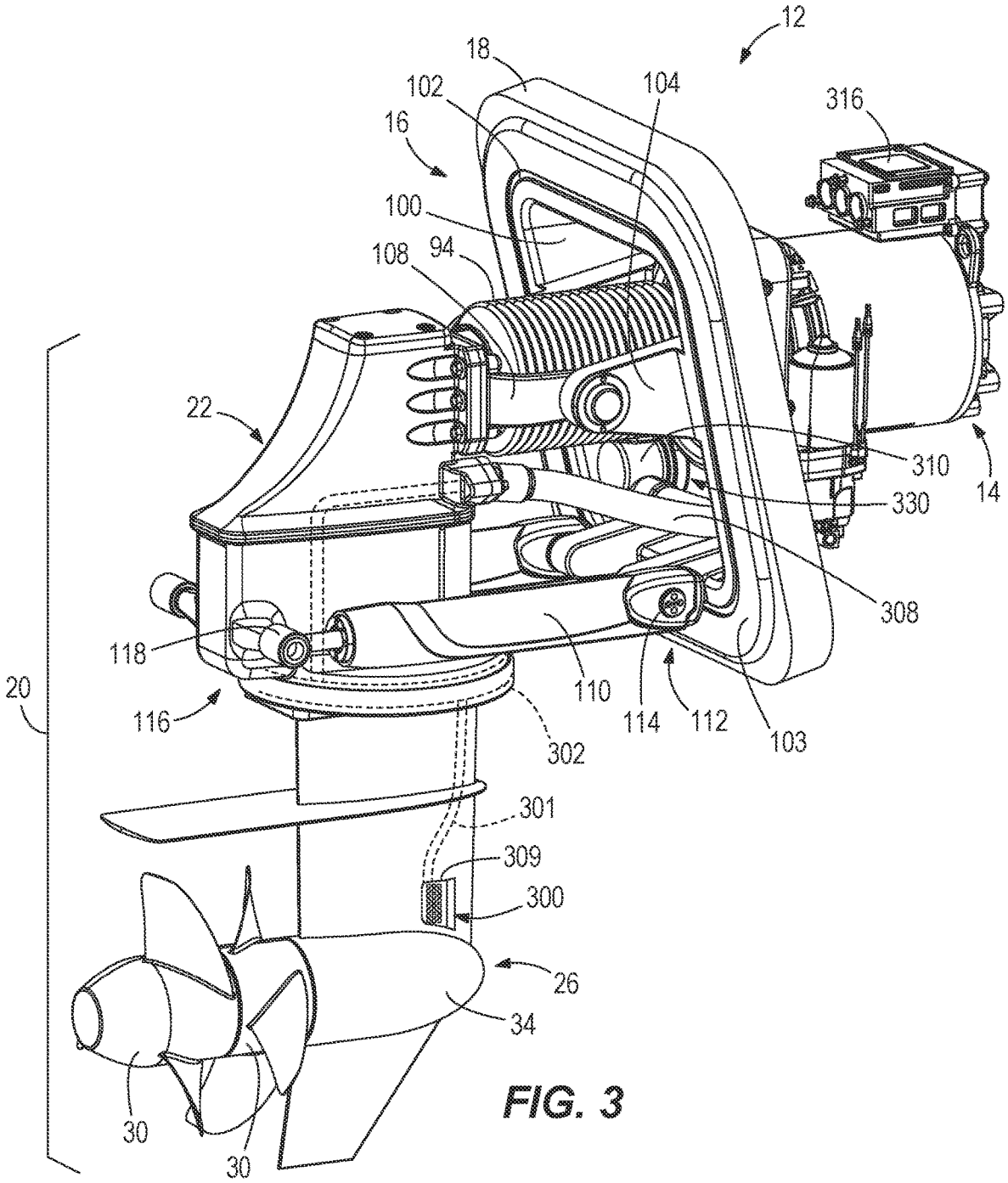
FIG. 3 is a starboard side perspective view of the marine drive.

Accordingly, the present inventors endeavored to develop systems and methods for operating the stern drive 12 that prevent or eliminate debris clogs and debris that block the water intake 300. As such, through experimentation and research, the present inventors have developed the presently disclosed methods of operating the stern drive 12 which advantageously leverage versatile operational features of the stern drive 12 which are available by way of incorporation of the electrically-operated components, such as the electric pump 310 (FIG. 3). As such the marine drives of the present disclosure are capable of varying the flow rate and/or the flow direction of the cooling water into or out of the water intake 300.

Figure 6:
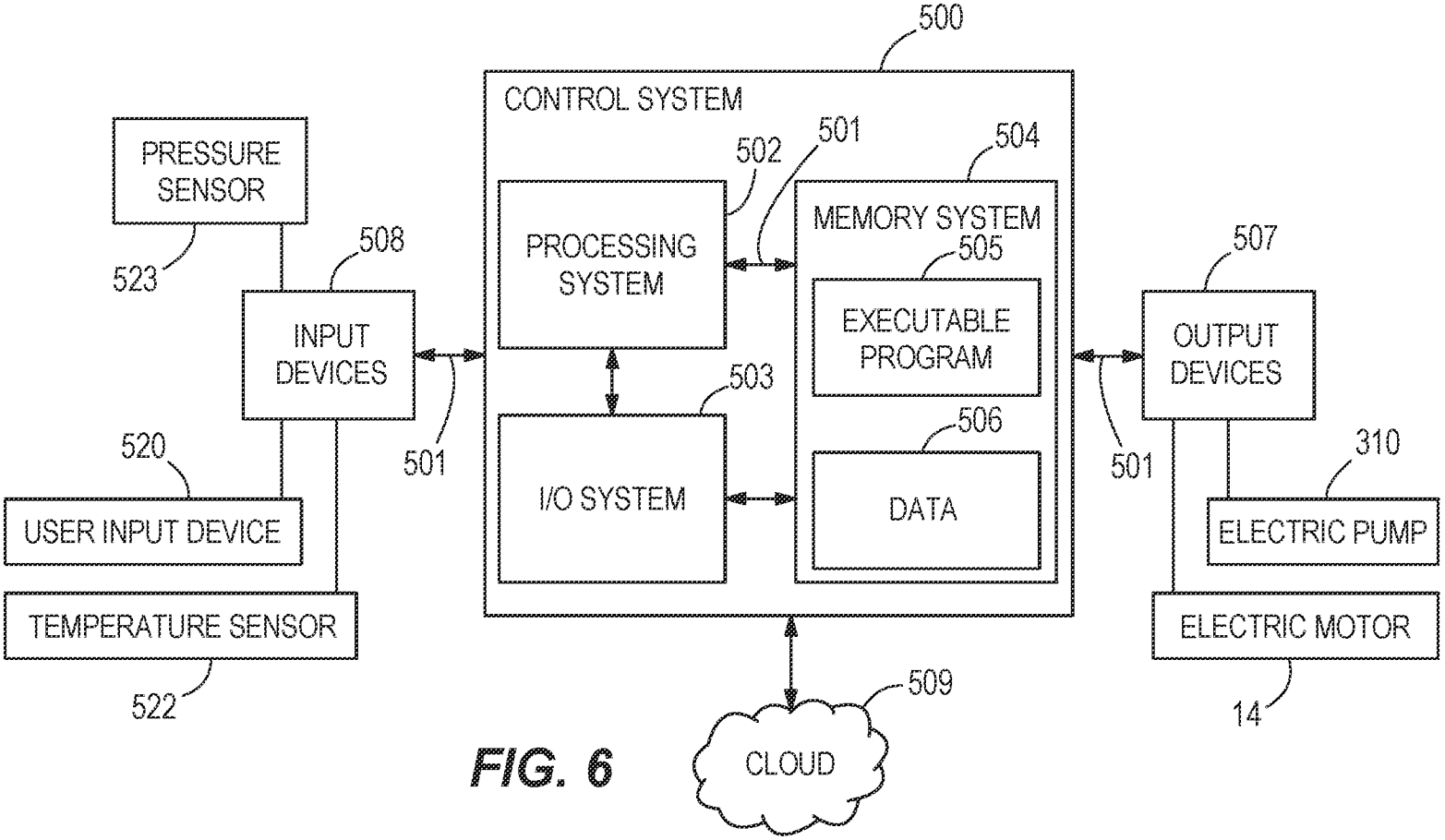
FIG. 6 is a flow chart depicting an example operation of the marine drive according to the present disclosure.

Referring now to FIG. 6, the drive assembly 20 (FIG. 1) is operable in one or more propulsion modes (as noted above) and a control system 500 is configured to change the propulsion mode based on inputs received via user inputs received into the control system 500. The control system 500 is also further configured to control operation of the electric pump 310 to thereby vary the flow direction and/or the flow rate of the water into and out of the water intake 300 and facilitate clearance of debris from the water intake 300 and/or the associated cooling system 330. For instance, the control system 500 is configured to automatically modify a speed and/or a direction of the electric pump 310 to facilitate clearance of debris from the water intake 300. This example operation of the electric pump 310, and other example operations of the electric pump 310, are described herein below in more detail.

FIG. 6 depicts an example control system 500 for controlling various components of the stern drive 12. The control system 500 is in communication with the electric motor 14 and the electric pump 310, and the control system 500 is configured to control operation of the electric motor 14 and the electric pump 310. More specifically, the control system 500 is configured to control a speed and a direction of the electric motor 14 for rotating the universal joint 50 which rotates the driveshaft 24 and the output shaft(s) 28 to thereby control the thrust force generated by the propulsor(s) 30 in the water. The control system 500 is also configured to control the speed and/or the direction of the electric pump 310 to thereby change the flow rate and/or the flow direction of the water being pumped by the electric pump 310.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 500 communicates with each of the one or more components of the stern drive 12 via a communication link 501, which can be any wired or wireless link. The control system 500 is capable of receiving information and/or controlling one or more operational characteristics of the stern drive 12 and its various sub-systems by sending and receiving control signals via the communication links 501. In one example, the communication link 501 is a controller area network (CAN) bus; however, other types of links could be used. In certain examples, the control system 500 is part of a larger control network such as a controller area network (CAN) or CAN Kingdom network, such as disclosed in U.S. Pat. No. 6,273,771, which is hereby incorporated by reference in its entirety.

It will be recognized that the extent of connections and the communication links 501 may in fact be one or more shared connections, or links, among some or all of the components in the stern drive 12. Moreover, the communication link 501 lines are meant only to demonstrate that the various control elements are capable of communicating with one another, and do not represent actual wiring connections between the various elements, nor do they represent the only paths of communication between the elements. Additionally, the stern drive 12 may incorporate various types of communication devices and systems, and thus the illustrated communication links 501 may in fact represent various different types of wireless and/or wired data communication systems.

The control system 500 may be a computing system that includes a processing system 502, memory system 504, and input/output (I/O) system 503 for communicating with other devices, such as input devices 508 (e.g., user input devices 520, temperature sensors 522, pressure sensors 523) and output devices 507 (e.g., electric pump 310), either of which may also or alternatively be stored in a cloud 509. The processing system 502 loads and executes an executable program 505 from the memory system 504, accesses data 506 stored within the memory system 504, and directs the stern drive 12 to operate as described in further detail below.

The processing system 502 may be implemented as a single microprocessor or other circuitry, or be distributed across multiple processing devices or sub-systems that cooperate to execute the executable program 505 from the memory system 504. Non-limiting examples of the processing system include general purpose central processing units, application specific processors, and logic devices.

The memory system 504 may comprise any storage media readable by the processing system 502 and capable of storing the executable program 505 and/or data 506. The memory system 504 may be implemented as a single storage device, or be distributed across multiple storage devices or sub-systems that cooperate to store computer readable instructions, data structures, program modules, or other data. The memory system 504 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

During operation of the marine vessel, the control system 500 is configured to send signals (e.g., electric control signals) to the electric motor 14 which cause the electric motor 14 to operate in a first direction to rotate the universal joint 50, the driveshaft 24, and the output shaft(s) 28 in a first direction such that the drive assembly 20 generates a first (e.g., forward) thrust force in the water via the propulsor(s) 30 (see FIGS. 1 and 4). Accordingly, the drive assembly 20 is in the forward mode (noted above). Alternately, the control system 500 sends signals to the electric motor 14 which cause the electric motor 14 to operate in an opposite, second direction, to rotate the universal joint 50, the driveshaft 24, and the output shaft(s) 28 in an opposite direction such that the drive assembly 20 generates a second (e.g., reverse) thrust force in the water via the propulsor(s) 30. Accordingly, the drive assembly 20 is in the reverse mode (noted above). It will be understood to those skilled in the art that the control system 500 may send signals to the electric motor 14 which cause the electric motor 14 to cease operation. i.e. cease rotation of universal joint 50, the driveshaft 24, and the output shaft(s) 28, such that the drive assembly 20 does not generate thrust force in the water. The electric motor 14 can also be configured to cease operation when no signals are received from the control system 500 (e.g., when a joystick or a throttle lever as the user input device 520 are in a neutral position).

Note that the drive assembly 20 undergoes a shift change as the propulsion mode of the drive assembly 20 changes (e.g., between forward mode, reverse mode, and neutral mode). For example, a shift change occurs as the drive assembly 20 changes from the neutral mode to the forward mode. The shift change occurs in response to a request for the shift change generated by a user input device 520 or the control system 500 more generally (e.g., for station keeping or waypoint tracking). In the example of providing a command via a user input device 520, the user input device 520 sends a shift change signal to the control system 500 which in turn controls operation of the electric motor 14. In a conventional manner, the user input device 520 is any device capable of receiving an input from the operator of the marine vessel, and in certain examples, the user input device 520 included one or more levers, joysticks, switches, or touch screens, and/or the like. Note that the example shift changes noted above may be for shifting gears or the like for any type of suitable marine drive. For example, shift changes can occur in marine drives having gearcases that utilize gears to achieve propulsor rotation, gearcases with fixed gears in the gearcase, single and multi-speed clutched transmissions, and/or crash box style transmissions/gearcases that are shiftable when the marine drive is off.

As noted above, the control system 500 is further configured to control the electric pump 310 (FIG. 3) to control the speed and/or the direction of the electric pump 310 and thereby change the flow rate and/or the flow direction of the water being pumped by the electric pump 310. Such operation of the electric pump 310 is advantageous to facilitate a clearance of debris from the water intake 300 (FIG. 3). For example, the control system 500 is configured to automatically modify the speed and/or the direction of the electric pump 310 to facilitate clearance of debris from the water intake 300. The automatic modification may be provided in accordance with the program saved in the memory system 504 (FIG. 6) which defines when this modification should occur, for how long, and the speeds and/or directions for operating the electric pump 310. In certain examples, the logic for automatic modification further includes considerations of other inputs or conditions such as a velocity of the marine vessel, a pressure of the cooling system 330, a water temperature, or others. The logic may be stored as an algorithm, a data table, and/or other forms within the memory system 504. In certain instances, the control system 500 is configured to send signals to the electric pump 310 to increase the speed thereof which results in an increased flow and flow rate of water through the water intake 300. As such, additional cooling water cools components of the stern drive 12 (FIG. 1), as described above.

In other instances, the control system 500 sends signals to the electric pump 310 to decrease the speed thereof which results in decreased flow of water through the water intake 300. Decreasing the flow of water through the water intake 300 also reduces the fluid pressure forces holding the debris over the water intake 300, and as such, the debris tends to fall away from the water intake 300. Furthermore, the water moving past the drive assembly 20 (FIG. 1), for example as the drive assembly 20 moves from the neutral mode to the reverse mode such that the propulsors 30 direct water past the water intake 300, may act to push or sweep the debris from the water intake 300.

In certain examples, the control system 500 is also configured to automatically modify the speed of the electric pump 310 based upon whether the drive assembly 20 undergoes a shift change or a request for shift change is received by the control system 500 via the user input device 520 from the neutral mode to either the forward mode and the reverse mode. In these examples, the change in speed of the electric pump 310 will advantageously result in a clearing of debris from the water intake 300 (as noted above). In further examples, the direction of the electric pump 310 is also or alternatively modified automatically, also based on the shift change or request for shift change.

In certain examples, the control system 500 is configured to determine whether the drive assembly 20 undergoes a shift change by comparing a current throttle amount or requested throttle amount to a stored throttle amount. These throttle amounts may be provided or percentages of the throttle position relative to the neutral position (e.g., 0.0% throttle in forward, 100.0% for full throttle in forward, −100.0% in reverse). The stored throttle amount corresponds to one or more throttle amounts at which a shift change occurs (e.g., the percentage of throttle lever position which the vessel will shift from neutral to forward) or example, if the stored throttle amount is zero throttle and the current throttle amount and/or the requested throttle amount is determined by the control system 500 to be greater than zero (such that the drive assembly 20 is in the forward mode or the reverse mode), the control system 500 determines that the drive assembly 20 has undergone a shift change. In certain examples, the modification of the speed of the electric pump 310 by the control system 500 can comprise slowing the speed of the electric pump 310 or stopping the electric pump 310 to reduce the fluid pressure forces that are acting to hold the debris to the water intake 300.

In certain examples, the control system 500 is configured to automatically revert the speed of the electric pump 310 to a predetermined speed after having automatically modified operation of the electric pump 310, such as after expiration of a predetermined time period stored in the memory system 504. The predetermined time period can be any amount of time (e.g., 0.001 seconds, 0.500 seconds, 1.0 seconds, 5.0 seconds). The predetermined speed is also stored in the memory system 504. In certain examples, the predetermined speed corresponds to a normal operating speed of the electric pump 310 at which the electric pump 310 pumps a sufficient amount of water to thereby properly cool the components of the stern drive. In other examples, the predetermined speed corresponds to the speed of the electric pump 310 before the control system 500 modifies the speed of the electric pump 310 to clear debris from the water intake 300 (as described above). In one non-limiting example, 3.000 seconds after the control system 500 reduces the speed of the electric pump 310 based on a determined shift change of the drive assembly 20 (as noted above), the control system 500 automatically reverts the speed of the electric pump 310 back to a normal operating speed. In other non-limiting examples, the control system 500 is configured to stop the electric pump for a predetermined time period (e.g., 5.000 seconds) each time the drive assembly 20 undergoes a shift change or a request for shift change when changing from the forward mode, the reverse mode, and/or the neutral mode.

In certain examples, the control system 500 is configured to automatically revert to the speed of the electric pump 310 after a temperature of at least one component (e.g., electric motor) of the stern drive 12 reaches a threshold temperature stored in the memory system 504. The threshold temperature can be any temperature (e.g., 180.0 degrees Fahrenheit), and the temperature is measured by one or more temperature sensors 522 configured to sense temperature of one or more components of the stern drive 12. The temperature sensors 522 are in communication with the control system 500. When the control system 500 determines that the sensed temperature, which is sensed by the temperature sensor 522, is equal to or greater than the threshold temperature, the control system 500 automatically reverts the speed and/or the direction of the electric pump 310 back to a normal operating speed. By reverting the speed of the electric pump 310 back to a normal operating speed, the control system 500 may increase the flow of water to heat-sensitive components of the stern drive 12 and thereby provide sufficient cooling to these components to prevent damage thereto. Note that in certain examples, the temperature sensor 522 can be configured to sense the temperature of the water discharged from the heat exchanger 314 or the outlet 315 (FIG. 1), and the control system 500 may adjust the speed of the electric pump 310 based on the temperature of the water. For instance, if the temperature of the water is greater than a threshold temperature, the control system 500 may increase the speed of the electric pump 310 examples of how much to increase in RPM and/or as a percentage of maximum speed to thereby increase flow of cooling water to heat-sensitive components of the stern drive 12 thereby cooling these components. In another instance, if the temperature of the water is less than a threshold temperature, the control system 500 may maintain or decrease the speed of the electric pump 310 to thereby provide ample flow of water and cooling to heat-sensitive components of the stern drive 12 without unnecessarily operating the electric pump 310 at higher than necessary speeds to maintain the temperature of the water below the threshold temperature. Note that the control system 500 could also stop the speed of the electric pump 310 when the temperature of the water is less than the threshold temperature thereby reducing power consumption and electric pump operation.

Note that in certain examples, the control system 500 can be configured to change the speed of the electric pump 310 to facilitate clearance of debris from the water intake 300 based on other operational parameters of the marine vessel. For instance, the control system 500 may modify the speed of the electric pump 310 based on cooling system pressure, motor rpm, motor direction, temperature of the inverter, boat speed, trim position, throttle position at the helm, when the marine vessel is above a minimum speed, when the marine vessel is executing a turn, and/or steering position. The control system 500 can also be configured to automatically revert the speed of the electric pump 310 to a predetermined speed (e.g., normal operating speed) of the electric pump 310 when the drive assembly 20 undergoes a shift change or a request for shift change from the least one of the forward mode and the reverse mode back to the neutral mode. In this way, changing the speed of the electric pump 310 as the drive assembly 20 changes from the forward mode or the reverse mode to the neutral mode automatically clears debris from the water intake 300 (also described above). In certain examples, a timer or rev counter included with the control system 500 is utilized during operation and control of the electric pump 310. In certain instances, after a shift change and the control system 500 waits for a predetermined time to pass (e.g., 5.000 second) or for a predetermined number of revs to be counted (e.g., 80.0 revs) before modifying the speed and/or the direction of the electric pump 310).

In certain examples, the electric pump 310 is a bidirectional electric pump and the control system 500 is configured to facilitate the clearance of debris from the water intake 300 by causing the electric pump to temporarily pump cooling water in a direction out of the water intake 300 instead of a direction into the water intake 300. As such, the cooling water clears debris from the water intake 300.

The control system 500 can also be configured to facilitate the clearance of debris from the water intake 300 by causing the electric pump 310 to pulse cooling water flow in a direction into or a direction out of the water intake 300 by respectively decreasing and then increasing the speed the electric pump 310 (e.g., pulsing the cooling water flow includes controlling the speed of the electric pump 310 to 0.0% of maximum speed for 1.0 seconds and 80.0% maximum speed for 3.0 seconds for 2.0 seconds, repeated three times) in one non-limiting instance. In another example, the control system 500 is configured to cycle the electric pump 310 'on' and 'off' to facilitate the clearance of debris from the water intake 300 by changing the flow of the water into the water intake 300.

In certain examples, the control system 500 is configured to automatically modify the speed of the electric pump 310 based on comparison of pressure of the cooling water relative to a predetermined threshold pressure which is stored on the memory system 504. The pressure of the cooling water may be sensed by the pressure sensor 532 upstream or downstream of the pump 310. The pressure sensor 523 is in communication with the control system 500. For example, when the control system 500 determines that the sensed pressure, which is sensed by the pressure sensor 532, is less than the threshold pressure the control system 500 automatically modifies the speed and/or the direction of the electric pump 310 to facilitate clearance of debris from the water intake 300. Note that in other examples, the control system 500 automatically modifies the speed and/or the direction of the electric pump 310 to facilitate clearance of debris from the water intake 300 when the sensed pressure is equal to or greater than the threshold pressure. In still other examples, the control system 500 is configured to compare the sensed pressure to one or more look-up tables and/or algorithms. The control system 500 can be configured to determine if the speed and/or the direction of the electric pump 310 should be modified based on an operational characteristic of the pump 310 (e.g., pump RPM), the speed of the marine vessel, and/or the sensed pressure. In one instance, for known pump RPM and/or marine vessel speed and the sensed pressure, the control system 500 will utilize one or more look-up tables and/or algorithms to thereby determine if the speed and/or the direction of the electric pump 310 should be changed to facilitate clearance of the water intake 300. For example, during normal operation of the pump 310 the speed is 1400.0 RPM with pressure of the cooling water in the cooling system 330 being 80.0 kpa. If the sensed pressure drops of 50.0 kpa while the speed of the pump 310 remains at 1400.0 RPM, the control system 500 determines that the water intake 300 is blocked and thereby changes the speed of the pump 310 to clear the blockage.

Figure 7:
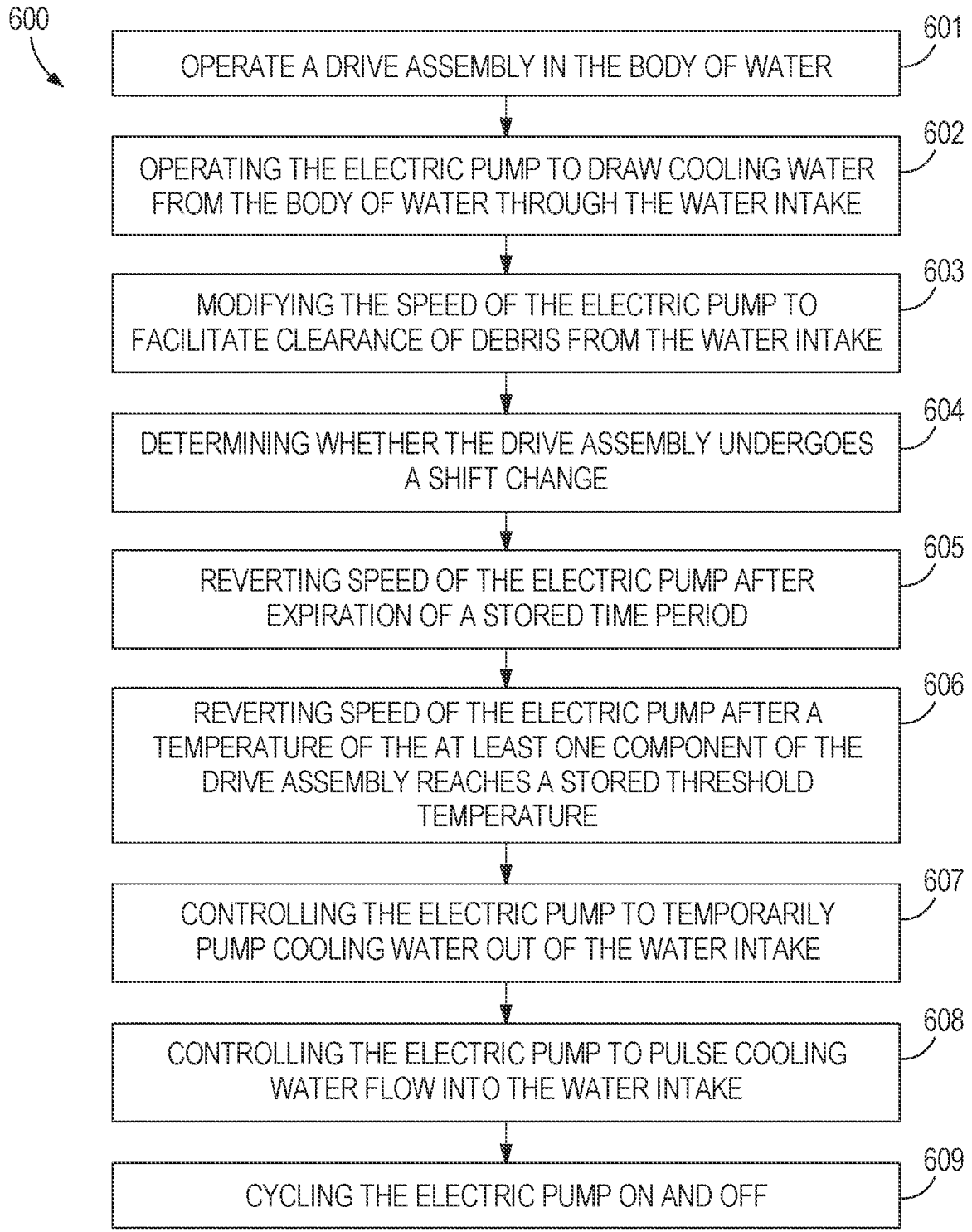
FIG. 7 is a schematic diagram of an example control system of the marine drive according to the present disclosure.

FIG. 7 depicts an example control method 600 for operating an example cooling system 330 of a marine drive, such as the stern drive 12 noted above with respect to FIGS. 1-5.

In the example method 600 depicted in FIG. 7, the method 600 includes at step 601 operating a drive assembly 20 in one of a neutral mode, in the forward mode for generating a forward thrust force in a body of water, and in the reverse mode for generating a reverse thrust force in the body of water. At step 602, the electric pump 310 is operated to draw cooling water from the body of water through the water intake 300 for cooling at least one component (e.g., the electric motor 14) of the stern drive 12. To facilitate clearance of debris from the water intake 300 (as noted above), at step 603, the control system 500 modifies the speed of the electric pump 310 such that the flow rate of the cooling water received through the water intake 300 changes. In certain examples, the control system 500 modifies the speed of the electric pump 310 by slowing or stopping the electric pump. The method 600 can further optionally include, at step 604, determining whether the drive assembly 20 undergoes a shift change between one of the propulsion modes (described above) by comparing a current throttle amount to a stored throttle amount (noted above). In certain examples, the control system 500 may control the electric pump to revert the speed of the electric pump 310 when the drive assembly 20 undergoes the shift change or after a predetermined amount of time passes after the shift change.

In certain examples, the method 600 optionally includes reverting speed of the electric pump 310 to the predetermined speed of the electric pump 310 after the expiration of a stored time period (described above), at step 605. In certain examples, the method 600 optionally includes reverting the speed of the electric pump 310 to a predetermined speed after a temperature of the at least one component of the drive assembly 20 reaches a stored threshold temperature (described above), at step 606. In certain examples, the method 600 optionally includes, at step 607, controlling the electric pump 310 to facilitate the clearance of debris from the water intake by causing the electric pump 310 to temporarily pump cooling water out of the water intake. In certain examples, the method 600 optionally includes, at step 608, controlling the electric pump 310 to facilitate the clearance of debris from the water intake by causing the electric pump to pulse cooling water flow into the water intake 300 by decreasing and then increasing the speed of the electric pump 310. In certain examples, the method 600 optionally includes, at step 609, cycling the electric pump 310 on and off to facilitate the clearance of debris from the water intake 300.

In non-limiting examples disclosed herein, a marine drive includes a drive assembly which is operable in a neutral mode, in a forward mode for generating a forward thrust force in a body of water, and in a reverse mode for generating a reverse thrust force in the body of water, a water intake configured to receive cooling water from the body of water for cooling at least one component of the drive assembly, an electric pump configured to draw the cooling water into the drive assembly via the water intake, and a control system configured to modify a speed and/or the direction of the electric pump to facilitate a clearance of debris from the water intake.

Optionally, the control system is configured to modify said speed of the electric pump based upon whether the drive assembly undergoes a shift change or a request for said shift change from the neutral mode to at least one of the forward mode and the reverse mode. Optionally, the control system is configured to determine whether the drive assembly undergoes said shift change by comparing a current throttle amount or requested throttle amount to a stored throttle amount. Optionally, the control system is configured to modify said speed of the electric pump by slowing or stopping the electric pump. Optionally, the control system is configured to revert said speed of the electric pump after expiration of a predetermined time period stored in a memory of the control system. Optionally, the control system is configured to revert said speed of the electric pump after a temperature of the at least one component of the marine drive reaches a threshold temperature stored in a memory of the control system. Optionally, the control system is configured to revert said speed of the electric pump when the drive assembly undergoes a shift change or a request for shift change from the at least one of the forward mode and the reverse mode back to the neutral mode. Optionally, the electric pump is a bidirectional electric pump and wherein the control system is configured to facilitate the clearance of debris from the water intake by causing the electric pump to pump cooling water out of the water intake instead of into the water intake. Optionally, the control system is configured to facilitate the clearance of debris from the water intake by causing the electric pump to pulse cooling water flow into the water intake by decreasing and then increasing said speed the electric pump. Optionally, the control system is configured to cycle the electric pump on and off to facilitate the clearance of debris from the water intake. Optionally, control system is configured to modify said speed of the electric pump based upon how a pressure of the cooling water in the cooling system compares to a stored threshold pressure.

In non-limiting examples disclosed herein, a method of operating a cooling system on a marine drive includes operating a drive assembly in one of a neutral mode, in a forward mode for generating a forward thrust force in a body of water, and in a reverse mode for generating a reverse thrust force in the body of water, operating an electric pump to draw cooling water from the body of water through a water intake for cooling at least one component of the marine drive, and modifying a speed and/or the direction of the electric pump to facilitate a clearance of debris from the water intake.

Optionally, the method includes modifying said speed of the electric pump based upon whether the drive assembly undergoes a shift change or a request for said shift change from the neutral mode to at least one of the forward mode and the reverse mode. Optionally, the method includes determining whether the drive assembly undergoes said shift change by comparing a current throttle amount to a stored throttle amount. Optionally, the method includes modifying said speed of the electric pump by slowing or stopping the electric pump. Optionally, the method includes reverting to said speed of the electric pump after expiration of a stored time period. Optionally, the method includes reverting to said speed of the electric pump after a temperature of the at least one component of the drive assembly reaches a stored threshold temperature. Optionally, the method includes reverting to said speed of the electric pump when the drive assembly undergoes said shift change. Optionally, the electric pump is a bidirectional electric pump and the method includes controlling the electric pump to facilitate the clearance of debris from the water intake by causing the electric pump to temporarily pump cooling water out of the water intake. Optionally, the method includes controlling the electric pump to facilitate the clearance of debris from the water intake by causing the electric pump to pulse cooling water flow into the water intake by decreasing and then increasing said speed of the electric pump. Optionally, the method includes cycling the electric pump on and off to facilitate the clearance of debris from the water intake. Optionally, the method includes modifying said speed of the electric pump based upon how a pressure of the cooling water in the cooling system compares to a stored threshold pressure.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples which occur to those skilled in the art. Such other examples are intended to be within the scope of the claims if they have features or structural elements which do not differ from the literal language of the claims, or if they include equivalent features or structural elements with insubstantial differences from the literal languages of the claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

What is claimed is:

1. A marine drive comprising:

a drive assembly operable in a neutral mode, a forward mode for generating a forward thrust force in a body of water, and a reverse mode for generating a reverse thrust force in the body of water, a water intake configured to receive water from the body of water for cooling at least one component of the drive assembly;

an electric pump configured to draw the water into the water intake; and a control system configured to modify an existing speed of the electric pump to facilitate a clearance of debris from the water intake the control system being configured to modify said existing speed based upon whether the drive assembly undergoes a shift change into one of the neutral mode, the forward mode, and the reverse mode.

2. The marine drive according to claim 1, wherein said shift change is from the neutral mode to the forward mode or the reverse mode.

3. The marine drive according to claim 1, further comprising an input device for requesting an adjustment to a current throttle amount of the drive assembly, wherein the control system is configured to determine whether the drive assembly undergoes said shift change by comparing a current throttle amount or a requested throttle amount to a stored throttle amount.

4. The marine drive according to claim 1, wherein the control system is configured to modify said existing speed by causing the electric pump to stop.

5. The marine drive according to claim 1, wherein the control system is configured to revert the electric pump to said existing speed after expiration of a time period stored in a memory of the control system.

6. The marine drive according to claim 1, wherein the control system is configured to revert the electric pump to said existing speed based on a comparison of a temperature of the at least one component of the marine drive to a threshold temperature stored in a memory of the control system.

7. The marine drive according to claim 2, wherein the control system is configured to revert the electric pump to said speed when the drive assembly undergoes a shift change from the forward mode or the reverse mode back to the neutral mode.

8. The marine drive according to claim 1, wherein the electric pump is a bidirectional electric pump and wherein the control system is configured to modify said existing speed by changing a direction of operation of the electric pump so the electric pump pumps said water out of the water intake.

9. A marine drive comprising;

a drive assembly operable in a neutral mode a forward mode for generating a forward thrust force in a body of water and a reverse mode for generating a reverse thrust force in the body of water;

a water intake configured to receive water from the body of water for cooling at least one component of the drive assembly;

an electric pump configured to draw the water into the water intake; and a control system configured to modify an operation of the electric pump based upon an operational characteristic of the marine drive to facilitate a clearance of debris from the water intake, wherein the control system is configured to facilitate the clearance of debris from the water intake by causing the electric pump to pulse the water into the water intake by alternately decreasing and increasing a speed of the electric pump.

10. The marine drive according to claim 9, wherein the control system is configured to cycle the electric pump on and off to facilitate the clearance of debris from the water intake.

11. A method of operating a cooling system on a marine drive, the method comprising:

operating a drive assembly in a first one of a neutral mode, a forward mode for generating a forward thrust force in a body of water, and a reverse mode for generating a reverse thrust force in the body of water;

operating an electric pump to draw water from the body of water through a water intake for cooling at least one component of the marine drive; and modifying an existing speed of the electric pump to facilitate a clearance of debris from the water intake based upon whether the drive assembly undergoes a shift change into a second one of the neutral mode, the forward mode, and the reverse mode.

12. The method according to claim 11, wherein said shift change is from the neutral mode to the forward mode or the reverse mode.

13. The method according to claim 11, further comprising determining whether the drive assembly undergoes said shift change by comparing a current throttle amount to a stored throttle amount.

14. The method according to claim 11, further comprising modifying said existing speed of the electric pump by stopping the electric pump.

15. The method according to claim 11, further comprising reverting the electric pump to said existing speed after expiration of a stored time period.

16. The method according to claim 11, further comprising reverting the electric pump to said speed after a temperature of the at least one component of the drive assembly reaches a stored threshold temperature.

17. The method according to claim 11, further comprising reverting the electric pump to said existing speed when the drive assembly undergoes a subsequent shift change.

18. The method according to claim 11, wherein the electric pump is a bidirectional electric pump and further comprising facilitating the clearance of debris from the water intake by causing the electric pump to temporarily pump the water out of the water intake.

19. A method of operating a cooling system on a marine drive, the method comprising:

operating a drive assembly in one of a neutral mode, a forward mode for generating a forward thrust force in a body of water, and a reverse mode for generating a reverse thrust force in the body of water;

operating an electric pump to draw water from the body of water through a water intake for cooling at least one component of the marine drive; and modifying an operation of the electric pump based upon an operational characteristic of the marine drive to facilitate a clearance of debris from the water intake; and controlling the electric pump to facilitate the clearance of debris from the water intake by causing the electric pump to pulse the water into the water intake by alternately decreasing and increasing a speed of the electric pump.

20. The method according to claim 19, further comprising cycling the electric pump on and off to facilitate the clearance of debris from the water intake.

21. A method of operating a cooling system on a marine drive, the method comprising:

operating a drive assembly in one of a neutral mode, a forward mode for generating a forward thrust force in a body of water, and a reverse mode for generating a reverse thrust force in the body of water;

operating an electric pump to draw water from the body of water through a water intake for cooling at least one component of the marine drive; and modifying a speed of the electric pump to facilitate a clearance of debris from the water intake based upon how a pressure of the water in the cooling system compares to a stored threshold pressure.

22. A marine drive comprising;

a drive assembly operable in a neutral mode, a forward mode for generating a forward thrust force in a body of water, and a reverse mode for generating a reverse thrust force in the body of water;

a water intake configured to receive water from the body of water for cooling at least one component of the drive assembly;

an electric pump configured to draw the water into the water intake; and a control system configured to modify a speed of the electric pump to facilitate a clearance of debris from the water intake based upon how a pressure of the water in a cooling system of the marine drive compares to a stored threshold pressure.

23. The marine drive according to claim 1, wherein the control system is configured to determine whether the drive assembly undergoes a shift change based upon a sensed characteristic of the drive assembly or a request for shift change inputted into the control system.

24. The method according to claim 11, further comprising determining whether the drive assembly undergoes a shift change based upon a sensed characteristic of the drive assembly or a request for shift change.

* * * * *